US009103204B2

(12) United States Patent
Yates

(10) Patent No.: US 9,103,204 B2
(45) Date of Patent: Aug. 11, 2015

(54) REMOTE COMMUNICATION WITH SUBSEA RUNNING TOOLS VIA BLOWOUT PREVENTER

(75) Inventor: Chad Eric Yates, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 909 days.

(21) Appl. No.: 13/248,813

(22) Filed: Sep. 29, 2011

(65) Prior Publication Data

US 2013/0083627 A1 Apr. 4, 2013

(51) Int. Cl.
*G01S 15/00* (2006.01)
*E21B 47/18* (2012.01)

(52) U.S. Cl.
CPC ..... *E21B 47/18* (2013.01)

(58) Field of Classification Search
CPC ..... E21B 33/08
USPC ..... 367/81, 83
See application file for complete search history.

(56) References Cited

U.S. PATENT DOCUMENTS

| | | | | |
|---|---|---|---|---|
| 4,862,426 | A | 8/1989 | Cassity et al. | |
| 6,343,654 | B1 * | 2/2002 | Brammer | 166/338 |
| 6,367,564 | B1 * | 4/2002 | Mills et al. | 175/40 |
| 6,614,229 | B1 * | 9/2003 | Clark et al. | 324/338 |
| 6,734,805 | B2 | 5/2004 | Johnson | |
| 7,513,308 | B2 | 4/2009 | Hose et al. | |
| 7,762,338 | B2 | 7/2010 | Fenton et al. | |
| 2002/0189806 | A1 * | 12/2002 | Davidson et al. | 166/250.01 |
| 2004/0149434 | A1 * | 8/2004 | Frey et al. | 166/250.1 |
| 2004/0200613 | A1 * | 10/2004 | Fripp et al. | 166/250.01 |
| 2004/0226720 | A1 * | 11/2004 | Schultz et al. | 166/321 |
| 2004/0246140 | A1 * | 12/2004 | Barbot et al. | 340/854.3 |
| 2005/0205248 | A1 * | 9/2005 | Barolak et al. | 166/66.5 |
| 2006/0065401 | A1 * | 3/2006 | Allen et al. | 166/345 |
| 2007/0000667 | A1 * | 1/2007 | MacKenzie et al. | 166/345 |

(Continued)

FOREIGN PATENT DOCUMENTS

| | | | |
|---|---|---|---|
| EP | 2157278 | A1 | 2/2010 |
| WO | 2012131600 | A | 10/2012 |

OTHER PUBLICATIONS

Francisco Kazuo Kobata et al., U.S. Appl. No. 13/040,002, filed Mar. 3, 2011, "Apparatus and Method for Measuring Weight and Torque at Downhole Locations while Landing, Setting, and Testing Subsea Wellhead Consumables.".

(Continued)

*Primary Examiner* — Amine Benlagsir
(74) *Attorney, Agent, or Firm* — Bracewell & Giuliani LLP

(57) ABSTRACT

An acoustic modem located on a blowout preventer stack communicates with a running tool acoustic modem located on a subsea running tool disposed within a subsea wellhead, tree or tubing spool. The acoustic modem and the running tool acoustic modern transmit and receive acoustic signals through a column of fluid in the blowout preventer stack. The acoustic modem is communicatively coupled to a subsea electronics module located on the blowout preventer stack and further communicatively coupled to a central control unit located on a platform at the surface. The running tool acoustic modem is communicatively coupled to a controller that receives data from sensors on the running tool and sends operational signals to functions of the running tool. An operator at the surface may control the running tool through the acoustic modems, and the running tool may communicate the running tool status to the operator through the acoustic modems.

20 Claims, 3 Drawing Sheets

(56) References Cited

U.S. PATENT DOCUMENTS

| | | | | |
|---|---|---|---|---|
| 2007/0007012 | A1* | 1/2007 | Bartlett et al. | 166/344 |
| 2008/0030365 | A1* | 2/2008 | Fripp et al. | 340/853.1 |
| 2009/0212969 | A1 | 8/2009 | Voss | |
| 2010/0165788 | A1 | 7/2010 | Rayssiguier | |
| 2011/0083854 | A1 | 4/2011 | Jennings | |
| 2011/0164468 | A1* | 7/2011 | Robbins et al. | 367/82 |
| 2011/0176387 | A1* | 7/2011 | Froelich | 367/82 |
| 2011/0205080 | A1* | 8/2011 | Millot et al. | 340/854.4 |
| 2011/0205847 | A1* | 8/2011 | Lemenager | 367/82 |
| 2012/0013893 | A1* | 1/2012 | Maida et al. | 356/73.1 |
| 2012/0048567 | A1* | 3/2012 | June | 166/368 |

OTHER PUBLICATIONS

Ryan Robert Herbel, U.S. Appl. No. 13/239,926, filed Sep. 22, 2011, "Method and System for Performing an Electrically Operated Function with a Running Tool in a Subsea Wellhead.".

Search Report and Written Opinion from corresponding Great Britain Application No. GB1217303.5, dated Nov. 20, 2012.

* cited by examiner

REMOTE COMMUNICATION WITH SUBSEA RUNNING TOOLS VIA BLOWOUT PREVENTER

BACKGROUND OF THE INVENTION

1. Field of the Invention

This invention relates in general to subsea running tools and, in particular, to remote communication from a surface platform to a subsea running tool through a blowout preventer.

2. Brief Description of Related Art

Subsea running tools are used to operate equipment within subsea wellheads and subsea christmas trees. This may include landing and setting of hangers, trees, wear bushings, logging tools, etc. Current running tools may be hydraulically or mechanically operated. For example, a running tool may be run to a subsea wellhead to land and set a casing hanger and associated casing string. A mechanical running tool will land and set the casing hanger within the wellhead by landing on a shoulder and undergoing a series of rotations using the weight of the casing string to engage dogs or seals of the casing hanger with the wellhead. A hydraulic running tool may land and set the casing hanger by landing the hanger on a shoulder in the wellhead, and then use drop balls or darts to block off portions of the tool. Hydraulic pressure will build up behind the ball or dart causing a function of the tool to operate to engage locking dogs of the hanger or set a seal between the hanger and wellhead. Pressure behind the ball or dart can then be increased further to cause the ball or dart to release for subsequent operations. Some tools may be combination mechanical and hydraulic tools and perform operations using both mechanical functions and hydraulically powered functions. These tools are extremely complex and require complex and expensive mechanisms to operate. These mechanisms are prone to malfunction due to errors in both design and manufacturing. As a result, the tools may fail at rates higher than desired when used to drill, complete, or produce a subsea well. Failure of the tool means the tool must be pulled from and rerun into a well, adding several days and millions of dollars to a job.

Further complicating matters are production running tools that require a hydraulic umbilical to be run with the running tool to power a hydraulic operation. These tools require the use of expensive equipment and additional time to run the umbilical within the riser and production or landing string. In addition, the umbilical takes up significant space within the riser. This places significant design limitations on other components that must be run within the riser, or the use of larger risers that require more costly rigs to run and land. Another issue is that these tools provide limited feedback to operators located on the rig. Limited feedback directed to torque applied, tension of the landing string, and displacement of the tool may be communicated back, but operators often do not have definitive confirmation that the tool has operated as intended at the subsea location. Therefore, a running tool that may be operated without the limitations described above would be desirable.

SUMMARY OF THE INVENTION

These and other problems are generally solved or circumvented, and technical advantages are generally achieved, by preferred embodiments of the present invention that provide remote communication from a surface platform to a subsea running tool via a blowout preventer.

In accordance with an embodiment of the present invention, a running tool assembly for performing a remote operation in at least one of a subsea wellhead and a subsea tree having a blowout preventer assembly disposed thereon, the blowout preventer being controlled by a subsea electronics module communicatively coupled to an umbilical extending to a surface platform is disclosed. The running tool assembly includes an acoustic modem in electronic communication with the subsea electronics module, the acoustic modem adapted to be mounted to the blowout preventer assembly so that the acoustic modem is in acoustic communication with a column of fluid within the blowout preventer assembly. The running tool assembly includes a running tool adapted to be suspended within at least one of the subsea wellhead and the subsea tree on a running string lowered from the surface platform through the blowout preventer assembly. A running tool acoustic modem is mounted to the running tool so that the running tool acoustic modem is in fluid communication with the column of fluid within the blowout preventer assembly. A central control unit is adapted to be located on the platform. The central control unit is in electronic communication with the subsea electronics module so that the central control unit may transmit and receive communicative signals to the subsea electronics module. The acoustic modem and the running tool acoustic modem may transmit to and receive acoustic signals from each other through the column of fluid in the blowout preventer assembly to transmit data and instructions between the running tool and the central control unit.

In accordance with another embodiment of the present invention, a system for communication with a subsea running tool is disclosed. The system includes a subsea wellhead disposed on a seafloor in a wellbore, and a blowout preventer assembly disposed above the subsea wellhead. The blowout preventer assembly has a central bore in fluid communication with a central bore of the subsea wellhead. An acoustic modem is mounted to the blowout preventer assembly so that the acoustic modem is in acoustic communication with a column of fluid within the blowout preventer assembly. A subsea electronics module is mounted to the blowout preventer and communicatively coupled to the acoustic modem. An umbilical extends from the blowout preventer to a surface platform to provide signals to the subsea electronics module to control the blowout preventer. A running tool suspended on a running string below the blowout preventer assembly. The running tool includes a running tool acoustic modem mounted to the running tool so that the running tool acoustic modem is in fluid communication with the column of fluid within the blowout preventer assembly. A central control unit is located on the platform. The central control unit is communicatively coupled to the subsea electronics module via the umbilical so that the central control unit may transmit and receive communicative signals to the subsea electronics module. The acoustic modem and the running tool acoustic modem may transmit to and receive acoustic signals from each other through the column of fluid in the blowout preventer assembly to transmit data and instructions between the running tool and the central control unit. Operative instructions are communicated from the central control unit to the subsea electronics module to the acoustic modem, and then to the running tool acoustic modem to operate a function of the running tool. Sensors located on the running tool communicate data corresponding to running tool status to a running tool controller and the running tool acoustic modem to the acoustic modem, the subsea electronics module, and the central control unit to provide information regarding running tool status to an operator located on the platform.

In accordance with yet another embodiment of the present invention, a method for communicating between a surface platform and a subsea running tool disposed within a subsea wellhead is disclosed. The method provides at least two acoustic modems in communication with fluid in a blowout preventer stack, wherein a first acoustic modem is positioned in the blowout preventer stack, and a second acoustic modem is positioned on a subsea running tool. The method communicatively couples the first acoustic modem to a subsea electronics module that is further communicatively coupled to a central control unit located at the platform. The method communicatively couples the second acoustic modem to a controller located on the subsea running tool. The method then transmits a signal between the first and second acoustic modems through the column of fluid in the blowout preventer stack, and converts the received acoustic signal to a communication signal for transmission to at least one of the central control unit and the controller of the subsea running tool.

An advantage of a preferred embodiment is that it provides, for communication between an operator located at a surface platform and a subsea running tool. The operator may select particular functions of the subsea running tool from a central control unit at the surface and then communicate a signal to the subsea running tool. The running tool may then perform the operation. In addition, embodiments provide a means for the running tool to communicate with the surface. The running tool may communicate various status signals to the surface that indicate whether an operation has performed, the rotational position of the tool following rotation at the surface, and/or amount of torque or weight applied at the running tool location. This all may be accomplished without the need to run a separate hydraulic umbilical through the riser and blowout preventer stack.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different foal's and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning rig operation, initial well completion, and the like have been omitted inasmuch as such details are not considered necessary to obtain a complete understanding of the present invention, and are considered to be within the skills of persons skilled in the relevant art.

Figure 1:
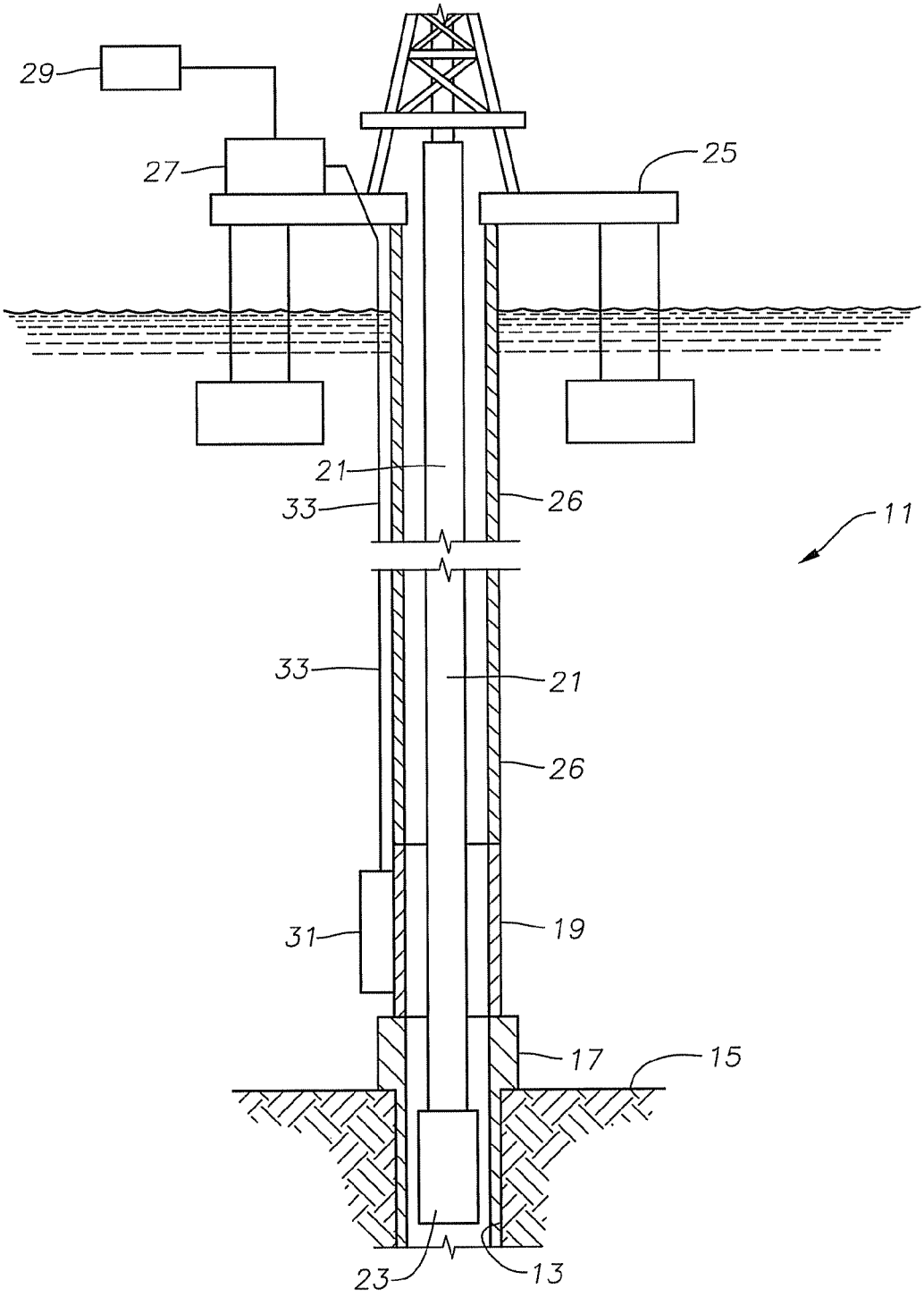
FIG. 1 is a schematic representation of a subsea system in accordance with a disclosed embodiment.

Referring to FIG. 1, a subsea assembly 11 is shown. Subsea assembly 11 is located in a wellbore 13 at a seafloor 15. Subsea assembly 11 includes a subsea wellhead 17 located at an upper end of wellbore 13, and a blowout preventer (BOP) stack 19 disposed on wellhead 17. A person skilled in the art will understand that wellhead 17 may include both a wellhead and a subsea tree. A running string 21 suspends a subsea running tool 23 in wellbore 13 or wellhead 17. Running string 21 extends from the location of subsea running tool 23 through BOP stack 19 and a riser 26 to a platform 25 located at a sea surface. Platform 25 may be a drilling, rig that may conduct various operations to drill and complete a subsea well. Subsea riser 26 may extend between BOP stack 19 and platform 25. A central control unit (CCU) 27 is positioned on platform 25 and is communicatively coupled to a driller's control panel (DCP) 29 or a toolpusher's control panel. CCU 27 is further communicatively coupled to a subsea electronics module (SEM) 31, located on a frame of BOP stack 19, by a communication umbilical 33 that extends on an exterior of subsea riser 26 to BOP stack 19 to platform 25. An umbilical reel (not shown) may be used to run communication umbilical 33 with running string 21 during running operations of subsea assembly 11.

Figure 2:
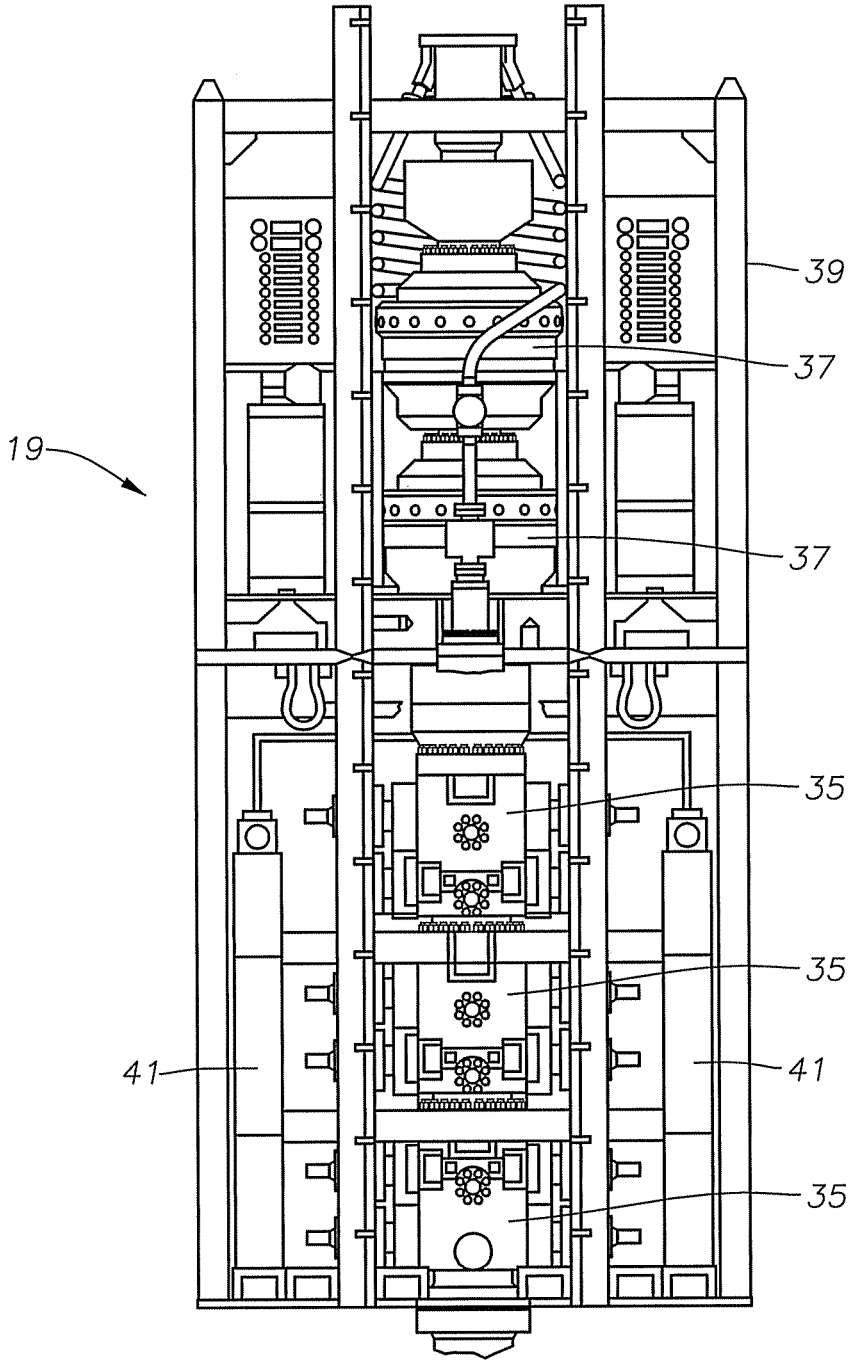
FIG. 2 is a schematic representation of a blowout preventer stack of FIG. 1 with a blowout preventer frame in accordance with a disclosed embodiment.
Figure 3:
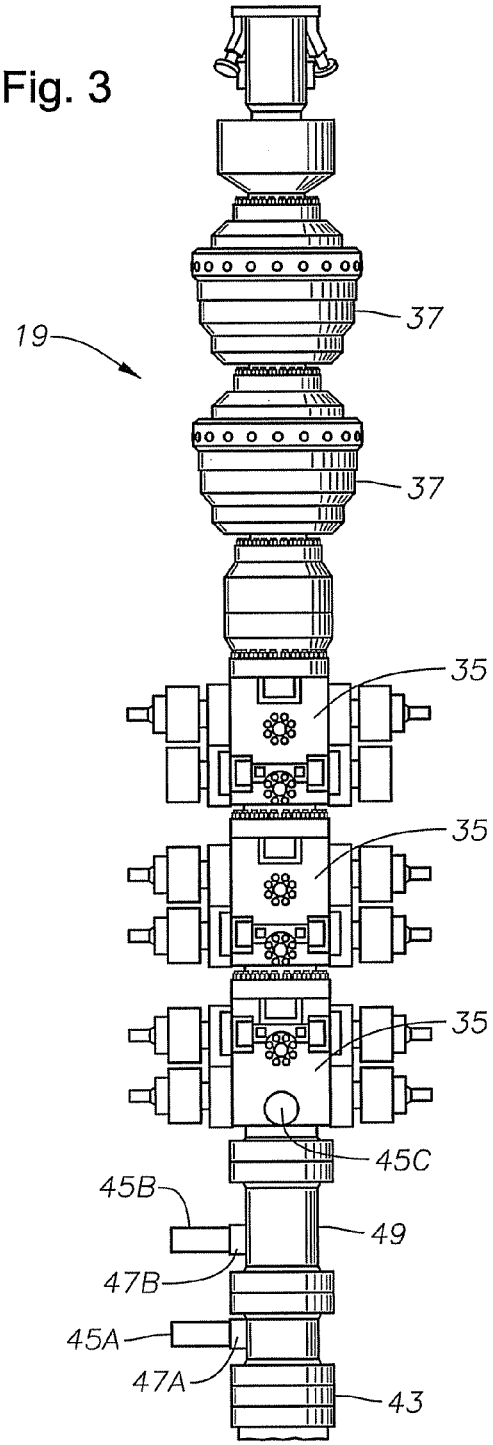
FIG. 3 is a schematic representation of the blowout preventer of FIG. 2 without the blowout preventer frame in accordance with a disclosed embodiment.

Referring now to FIG. 2 and FIG. 3, BOP stack 19 includes at least one shear ram assembly 35, three of which are shown, and at least one annular blowout preventer assembly 37, two of which are shown. BOP stack 19 includes a BOP stack frame 39 that is mounted around BOP stack 19. BOP stack frame 39 provides a mounting position for SEM 31 (not shown in FIG. 2 and FIG. 3), as well as additional equipment such as hydraulic accumulators 41, and the like. Hydraulic accumulators may provide hydraulic power for some subsea hydraulic components such as shear assemblies 35. An operator may send signals from platform 25 through communication umbilical 33 to SEM 31. The signals may be operation signals that instruct shear assemblies 35, annular BOPs 37, and other subsea operations to operate.

Referring to FIG. 3, BOP stack 19 includes a subsea wellhead connector 43, and an acoustic modem 45, three of which are shown in FIG. 3. Subsea wellhead connector 43 mounts to subsea wellhead 13 (FIG. 1). Acoustic modem 45 may be mounted in any of the three positions shown in FIG. 3. In the first position, acoustic modem 45A mounts to wellhead connector 43 through a modem bonnet 47A. In the second position, acoustic modem 45B mounts through modem bonnet 47B in a separate tubular member 49 positioned between wellhead connector 43 and the first shear assembly 35. In the third position, acoustic modem 45C mounts within a ram cavity of the first shear assembly 35. A person skilled in the art will understand that any of the three mounting positions shown may be used independently of the other two and are shown together for illustrative purposes only. Described embodiments are directed to use of a single acoustic modem mounted to BOP stack 19, although alternative embodiments may include mounting of more than one acoustic modem to BOP stack 19. These alternative embodiments are contemplated and included in the disclosed embodiments. In each mounting position, acoustic modem 45 will communicate with the fluid in a riser string or running string 21 (FIG. 1) surrounding running tool 23.

Acoustic modems 45A, 45B, and 45C, are all of similar types and are equivalents of acoustic modem 45 discussed below. In an embodiment, acoustic modem 45 contains an acoustic transmitter for communication of acoustic signals into the column of fluid within BOP stack 19. In another embodiment, acoustic modem 45 contains an acoustic receiver for receiving acoustic signals transmitted through the column of fluid in BOP stack 19. In still another embodiment, acoustic modem 45 contains an acoustic receiver and an acoustic transmitter so that acoustic modem 45 may both transmit and receive acoustic signals through the column of fluid within. BOP stack 19. Acoustic modem 45 may be communicatively coupled to SEM 31 (FIG. 1). In an embodiment, this is done through an electrical cable mounted to BOP stack frame 39 that extends from the mounting location of acoustic modem 45 to SEM 31. Although not shown in FIG. 2 and FIG. 3, running string 21 and running tool 23 will be suspended within BOP stack 19 so that running tool 23 may interact with subsea wellhead 17.

Figure 4:
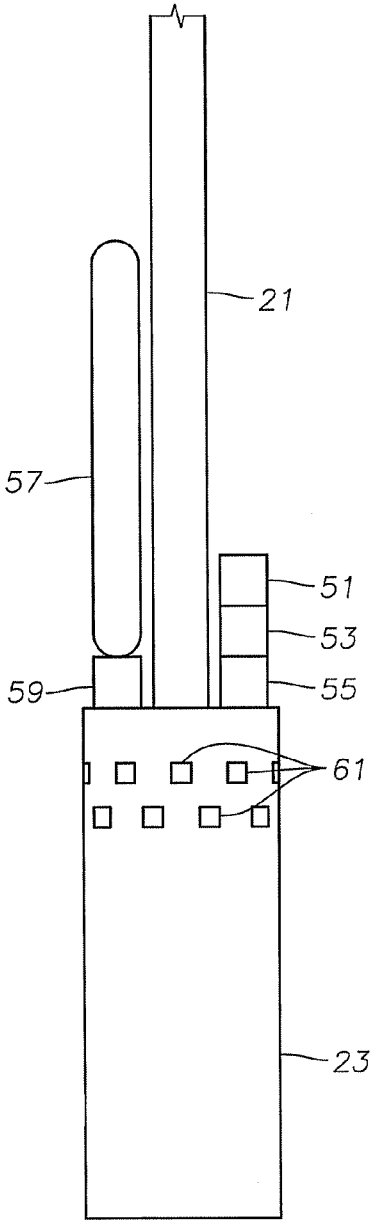
FIG. 4 is a schematic representation of a running tool of FIG. 1 in accordance with a disclosed embodiment.

Referring to FIG. 4, running tool 23 is shown suspended on running string 21. Running tool 23 may comprise a tubing hanger running tool, an internal tree cap running tool, a pressure test tool, a casing hanger running tool, a lead impression tool, a seal retrieval tool, or the like. Running tool 23 may include a running tool acoustic modem 51, a controller or processor 53, and a power supply 55. Running tool 23 may also include hydraulic accumulators 57 and hydraulic valves 59. Still further running tool 23 may include a plurality of sensors 61. Power supply 55 may comprise a battery source having sufficient charge to provide electric potential to the electrically operated devices/functions of running tool 23. In the illustrated embodiment, this may include providing power for operation of running tool acoustic modem 51, controller 53, sensors 61, and hydraulic valves 59. A person skilled in the art will understand that these functions and components may comprise integral components of running tool 23. A person skilled in the art will understand that these functions and components may comprise a separate module coupled to running tool 23. A person skilled in the art will understand that running tool 23 may include various combinations of the components described above, selected to perform a particular function within subsea wellhead 17.

Each operation may be communicatively coupled with controller 53 to both receive signals from and transmit signals to controller 53. For example, controller 53 may transmit signals to hydraulic valves 59, causing hydraulic valves 59 to open or close in response. Similarly, sensors 61 may transmit signals to controller 53 that provide measurements of selected parameters at running tool 23. In an embodiment, at least one of the sensors 61 may be an azimuth sensor that provides heading information processed by the controller to indicate the number of turns running tool 23 may have undergone in response to rotation of running string 21 at platform 25. Other sensors 61 may provide temperature, pressure, torque, axial position, and tension data to controller 53.

Controller 53 may transmit power to and transmit and receive communication signals to and from running tool acoustic modem 51. In an embodiment, running tool acoustic modem 51 may contain an acoustic transmitter. In another embodiment, running tool acoustic modem 51 may contain an acoustic receiver. In still other embodiments, running tool acoustic modem 51 may contain both an acoustic transmitter and an acoustic receiver. Running tool acoustic modem 51 may be in acoustic communication with the fluid in BOP stack 19. Thus, depending on the embodiment, running tool acoustic modem 51 may both receive acoustic signals through, and transmit acoustic signals into, the column of fluid in BOP stack 19. For example, running tool acoustic modem 51 may receive an acoustic signal transmitted through the column of fluid in BOP stack 19. Running tool acoustic modem 51 may then transmit the signal to controller 53, where the signal is processed. Controller 53 may in turn communicate with the various functions of running tool 23 in response to the received signal. For example, controller 53 may transmit a signal to hydraulic valve 59 to allow hydraulic pressure from hydraulic accumulators 57 to flow and operate a function of running tool 23. In another embodiment, controller 53 may receive signals from sensors 61. Controller 53 may then process the signals and transmit the signals to running tool acoustic modem 51, where running tool acoustic modem 51 may transmit the acoustic signals into the column of fluid in BOP stack 19.

Communication may occur between running tool acoustic modem 51 and acoustic modem 45 located on BOP stack 19. Thus, acoustic signals transmitted into the column of fluid of BOP stack 19 by acoustic modem 45 and running tool acoustic modem 51 may, in turn, be received by running tool acoustic modem 51 and acoustic modem 45, respectively. In turn, each modem, may then further transmit the received signal to the appropriate equipment. For example, an operator located on platform 25 (FIG. 1) may require operation of a hydraulic function of running tool 23. The operator may interact with DCP 29 (FIG. 1) to send a signal to CCU 27 (FIG. 1). CCU 27 may then send a signal to SEM 31 through electrical umbilical 33. There, SEM 31 will communicate the signal to acoustic modem 45, where the signal may be converted from an electrical signal to an acoustic signal and transmitted into the column of fluid within BOP stack 19. Referring to FIG. 4, running tool acoustic modem 51 may then receive the acoustic signal and transmit the signal to controller 53 for operation of hydraulic valves 59 for release of hydraulic pressure within hydraulic accumulators 57.

Similarly, during a mechanical operation of running tool 23, such as rotation of running tool 23 during the process of engaging a seal between a casing hanger and wellhead 13 (FIG. 1), a sensor 61, such as an azimuth sensor, may transmit a signal to controller 53 corresponding to the amount of rotational movement of running tool 23. Controller 53 may then process the information and transmit a signal to running tool acoustic modem 51. Running tool acoustic modem 51 may then transmit an acoustic signal into the column of fluid of BOP stack 19 corresponding to the data of sensor 61. Acoustic modem 45 may then receive the acoustic signal through the column of fluid of BOP stack 19. The signal may then be processed and transmitted to the surface through SEM 31, electrical umbilical 33, and CCU 27, where it may then be displayed to an operator on DCP 29. The operator may then conduct an appropriate action in response. For example, if four rotations of running tool 23 at the subsea location are needed to perform the mechanical operation, the operator may add additional rotations at the surface to compensate for twisting of running string 21 that may absorb a rotation due to the length of running string. 21 based on the information received from running tool 23. In alternative embodiments, sensor 61 may generate a signal in response to successful completion of a hydraulic operation by running tool 23.

The disclosed embodiments have been discussed primarily with respect to subsea drilling operations. A person skilled in the art will understand that the disclosed embodiments may also be used with production operations. Such embodiments are contemplated and included in the embodiments disclosed herein. In addition, the disclosed embodiments may provide positive confirmation of performance of an operation by the subsea running tool.

Accordingly, the disclosed embodiments provide numerous advantages. For example, the disclosed embodiments provide a system for communication between a running tool located subsea and an operator located on a sea surface. This allows communication of instructions downhole to the running tool for operation of hydraulic functions without the need for a hydraulic umbilical. In addition, the system provides a means to communicate information from the subsea location to the surface with sufficient speed to allow the operator to adjust operations at the surface to account for conditions at the subsea location. Still further the communication system employs existing umbilicals and subsea electronics modules to operate the running tool. This allows operators to gain additional functionality out of these apparatuses that are typically only used to control the subsea blowout preventer. As disclosed herein, the existing umbilicals and subsea electronics modules may be used to operate the subsea blowout preventer, and a subsea running tool disposed within and below the blowout preventer.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A running tool assembly for performing a remote operation in at least one of a subsea wellhead and a subsea tree having a blowout preventer assembly disposed thereon, the running tool assembly comprising:

the blowout preventer assembly being controlled by a subsea electronics module communicatively coupled to an umbilical extending to a surface platform;

an acoustic modem in electronic communication with the subsea electronics module, the acoustic modem mounted to the blowout preventer assembly, wherein the acoustic modem is in acoustic communication with a column of fluid within the blowout preventer assembly;

a running tool suspended within at least one of the subsea wellhead and the subsea tree on a running string lowered from the surface platform through the blowout preventer assembly;

a running tool acoustic modem mounted to the running tool, wherein the running tool acoustic modem is in fluid communication with the column of fluid within the blowout preventer assembly;

a central control unit located on the surface platform, the central control unit in electronic communication with the subsea electronics module, wherein the central control unit transmits and receives communicative signals to the subsea electronics module; and wherein the acoustic modem and the running tool acoustic modem transmit to and receive acoustic signals from each other through the column of fluid in the blowout preventer assembly, wherein the blowout preventer assembly to transmit data and instructions between the running tool and the central control unit;

wherein sensors located on the running tool communicate the data corresponding to running tool status to a running tool controller, to the running tool acoustic modem, to the acoustic modem, to the subsea electronics module, and to the central control unit to provide information regarding the running tool status to an operator located on the surface platform.

2. The running tool assembly of claim 1, wherein:

the acoustic modem comprises an acoustic transmitter;

the running tool acoustic modem comprises an acoustic receiver; and wherein operative instructions are communicated from the central control unit via the umbilical to the subsea electronics module to the acoustic modem, and then to the running tool acoustic modem to operate a function of the running tool.

3. The running tool assembly of claim 2, further comprising:

a hydraulic accumulator is mounted to the running tool;

at least one hydraulic valve is mounted to the running tool to control fluid pressure between the hydraulic accumulator and a hydraulic function of the running tool; and wherein the operative instructions instruct the running tool controller to actuate the at least one hydraulic valve to provide hydraulic pressure to the hydraulic function of the running tool.

4. The running tool assembly of claim 1, wherein:

the acoustic modem comprises an acoustic receiver;

the running tool acoustic modem comprises an acoustic transmitter.

5. The running tool assembly of claim 4 wherein at least one of the sensors comprises an azimuth sensor that provides a rotational position of the running tool.

6. The running tool assembly of claim 1, wherein:

the acoustic modem comprises an acoustic transmitter and an acoustic receiver;

the running tool acoustic modem comprises an acoustic receiver and an acoustic transmitter;

wherein operative instructions are communicated from the central control unit to the subsea electronics module to the acoustic modem, and then to the running tool acoustic modem to operate a function of the running tool.

7. The running tool assembly of claim 6, further comprising:

a hydraulic accumulator is mounted to the running tool;

at least one hydraulic valve is mounted to the running tool to control fluid pressure between the hydraulic accumulator and a hydraulic function of the running tool;

wherein the operative instructions instruct the running tool controller to actuate the at least one hydraulic valve to provide hydraulic pressure to the hydraulic function of the running tool; and at least one of the sensors comprises a positive indicator sensor that provides positive indication of an operation of the hydraulic function of the running tool.

8. The running tool assembly of claim 1, wherein the running tool comprises at least one of:

a tubing hanger running tool for landing and setting a tubing hanger in at least one of the subsea wellhead, the subsea tree, and a tubing spool;

an internal tree cap running tool for landing and setting a tree cap;

a pressure tool for pressure testing at least one of the subsea wellhead and the subsea tree;

a casing hanger running tool for landing and setting a casing hanger in at least one of the subsea wellhead and a landing sub;

a lead impression tool for taking measurements of an axial position of the casing hanger;

a clean and flush tool for cleaning annulus seal pockets in the subsea wellhead; or a seal retrieval tool for removing annulus seals.

9. The running tool assembly of claim 1, wherein the acoustic modem is mounted to a subsea wellhead connector of the blowout preventer assembly.

10. The running tool assembly of claim 1, wherein the acoustic modem is mounted in an acoustic modem bonnet disposed between a subsea wellhead connector and the blowout preventer assembly.

11. The running tool assembly of claim 1, wherein the acoustic modem is mounted in an acoustic modem bonnet coupled to a first blowout preventer cavity of the blowout preventer assembly.

12. A system for communication with a subsea running tool comprising:

a subsea wellhead disposed on a seafloor in a wellbore;

a blowout preventer assembly disposed above the subsea wellhead, the blowout preventer assembly having a central bore in fluid communication with a central bore of the subsea wellhead;

an acoustic modem mounted to the blowout preventer assembly, wherein the acoustic modem is in acoustic communication with a column of fluid within the blowout preventer assembly;

a subsea electronics module mounted to the blowout preventer assembly and communicatively coupled to the acoustic modem;

an umbilical extending from the blowout preventer assembly to a surface platform for providing signals to the subsea electronics module to control the blowout preventer assembly;

a running tool suspended on a running string below the blowout preventer assembly;

a running tool acoustic modem mounted to the running tool, wherein the running tool acoustic modem is in fluid communication with the column of fluid within the blowout preventer assembly;

a central control unit located on the surface platform, wherein the central control unit is communicatively coupled to the subsea electronics module via the umbilical, and the central control unit transmits and receives communicative signals to the subsea electronics module;

wherein the acoustic modem and the running tool acoustic modem transmit to and receive acoustic signals from each other through the column of fluid in the blowout preventer assembly, wherein the blowout preventer assembly to transmit data and instructions between the running tool and the central control unit;

wherein sensors located on the running tool communicate the data corresponding to running tool status to a running tool controller, to the running tool acoustic modem, to the acoustic modem, to the subsea electronics module, and to the central control unit to provide information regarding the running tool status to an operator located on the surface platform.

13. The system of claim 12, further comprising:

a control panel is communicatively coupled to the central control unit for presentation to the operator the information communicated between the running tool and the central control unit, wherein the acoustic modem comprises an acoustic transmitter and an acoustic receiver;

and the running tool acoustic modem comprises an acoustic receiver and an acoustic transmitter.

14. The system of claim 12, further comprising:

a hydraulic accumulator is mounted to the running tool;

at least one hydraulic valve is mounted to the running tool to control fluid pressure between the hydraulic accumulator and a hydraulic function of the running tool, wherein operative instructions instruct the running tool controller to actuate the at least one hydraulic valve to provide hydraulic pressure to the hydraulic function of the running tool; and at least one of the sensors comprises a positive indicator sensor that provides positive indication of an operation of the hydraulic function of the running tool.

15. The system of claim 12, wherein a subsea tree is interposed between the subsea wellhead and the blowout preventer assembly.

16. The system of claim 12, wherein operative instructions are communicated from the central control unit to the subsea electronics module to the acoustic modem, and then to the running tool acoustic modem to operate a function of the running tool.

17. A method for communicating between a surface platform and a subsea running tool disposed within a subsea wellhead having a blowout preventer stack mounted thereon, the method comprising:

(a) providing at least two acoustic modems in communication with a column of fluid in the blowout preventer stack, wherein a first acoustic modem is mounted in the blowout preventer stack, and a second acoustic modem is positioned on the subsea running tool, wherein the blowout preventer stack being controlled by a subsea electronics module via an umbilical extending to a central control unit located in the surface platform and the central control unit transmits and receives communication signals to the subsea electronics module;

(b) electronically coupling the first acoustic modem to the subsea electronics module via wiring, wherein the first acoustic modem is in acoustic communication with the column of fluid within the blowout preventer stack, and;

(c) electronically coupling the second acoustic modem to a controller located on the subsea running tool via wiring, wherein the subsea running tool is suspended on a running string below the blowout preventer stack, and the second acoustic modem mounted to the subsea running tool wherein the second acoustic modem is in fluid communication with the column of fluid within the blowout preventer stack; and (d) transmitting acoustic signals from the second acoustic modem to the first acoustic modem through the column of fluid in the blowout preventer stack, and converting the acoustic signals to the communication signals that are conveyed by the subsea electronics module through the umbilical to the central control unit;

wherein sensors located on the subsea running tool communicate data corresponding to subsea running tool status to a subsea running tool controller, to the second acoustic modem, to the first acoustic modem, to the subsea electronics module, and to the central control unit to provide information regarding the subsea running tool status to an operator located on the surface platform.

18. The method of claim 17, further comprises:

generating a status signal with a sensor located on the subsea running tool corresponding to at least one of rotational position of the subsea running tool, torque at the subsea running tool, weight at the subsea running tool, or operational position of the subsea running tool.

19. The method of claim 17, further comprises:

generating an operational signal at the central control unit in response to an operation selection by the operator;

communicating the operational signal to the subsea electronics module via the umbilical and from the subsea electronics module to the first acoustic modem;

converting the operational signal to an acoustic operational signal;

transmitting the acoustic operational signal through the column of fluid in the blowout preventer stack;

receiving the acoustic operational signal with the second acoustic modem;

converting the acoustic operational signal with the second acoustic modem to an electric operational signal;

communicating the electric operational signal to the controller; and operating a function of the subsea running tool in response to the electric operational signal.

20. The method of claim 19, wherein said operating the function of the subsea running tool comprises actuation of hydraulic valves of the subsea running tool to release hydraulic pressure stored within hydraulic accumulators of the subsea running tool for operation of a hydraulically powered function.

* * * * *